United States Patent [19]

Greis

[11] Patent Number: 4,948,057

[45] Date of Patent: Aug. 14, 1990

[54] DEVICE AND PROCESS TO GUIDE, HOLD AND CONVEY A YARN DURING BOBBIN REPLACEMENT

[75] Inventor: Dietmar Greis, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 255,551

[22] Filed: Oct. 11, 1988

[30] Foreign Application Priority Data

Oct. 12, 1987 [DE] Fed. Rep. of Germany ..... 3734478

[51] Int. Cl.[5] ..... B65H 54/02

[52] U.S. Cl. ..... 242/18 R; 242/18 PW; 242/158 B

[58] Field of Search ..... 242/18 R, 18 PW, 18 A, 242/18 DD, 35.5 A, 25 R, 25 A, 43 R, 43.1, 158 B

[56] References Cited

U.S. PATENT DOCUMENTS

| | | | |
|---|---|---|---|
| 2,184,334 | 12/1939 | Brucker | 242/18 PW |
| 3,338,529 | 8/1967 | Collins | 242/43.1 |
| 3,908,918 | 9/1975 | Bergstrom | 242/18 PW X |
| 3,971,517 | 7/1976 | Matuura et al. | 242/18 PW X |
| 4,105,165 | 8/1978 | Miyazaki et al. | 242/18 PW |
| 4,154,409 | 5/1979 | Reisser et al. | 242/18 PW |
| 4,483,490 | 11/1984 | Engmann et al. | 242/18 PW X |
| 4,666,096 | 5/1987 | Heel et al. | 242/36 |
| 4,752,043 | 6/1988 | Heinzer | 242/18 R |
| 4,765,552 | 8/1988 | Sugioka et al. | 242/36 |

*Primary Examiner*—Stanley N. Gilreath
*Attorney, Agent, or Firm*—Dority & Manning

[57] ABSTRACT

In a spinning and winding machine, a continuously fed yarn is wound into a cross-wound bobbin. When a predetermined diameter of the cross-wound bobbin has been reached, the cross-wound bobbin is replaced by an empty bobbin holder.

The yarn is moved to a lateral area next to the winding zone. The yarn is guided during all winding and bobbin replacement processes by a microprocessor-controlled step motor, by means of a cross-winding guide.

19 Claims, 1 Drawing Sheet

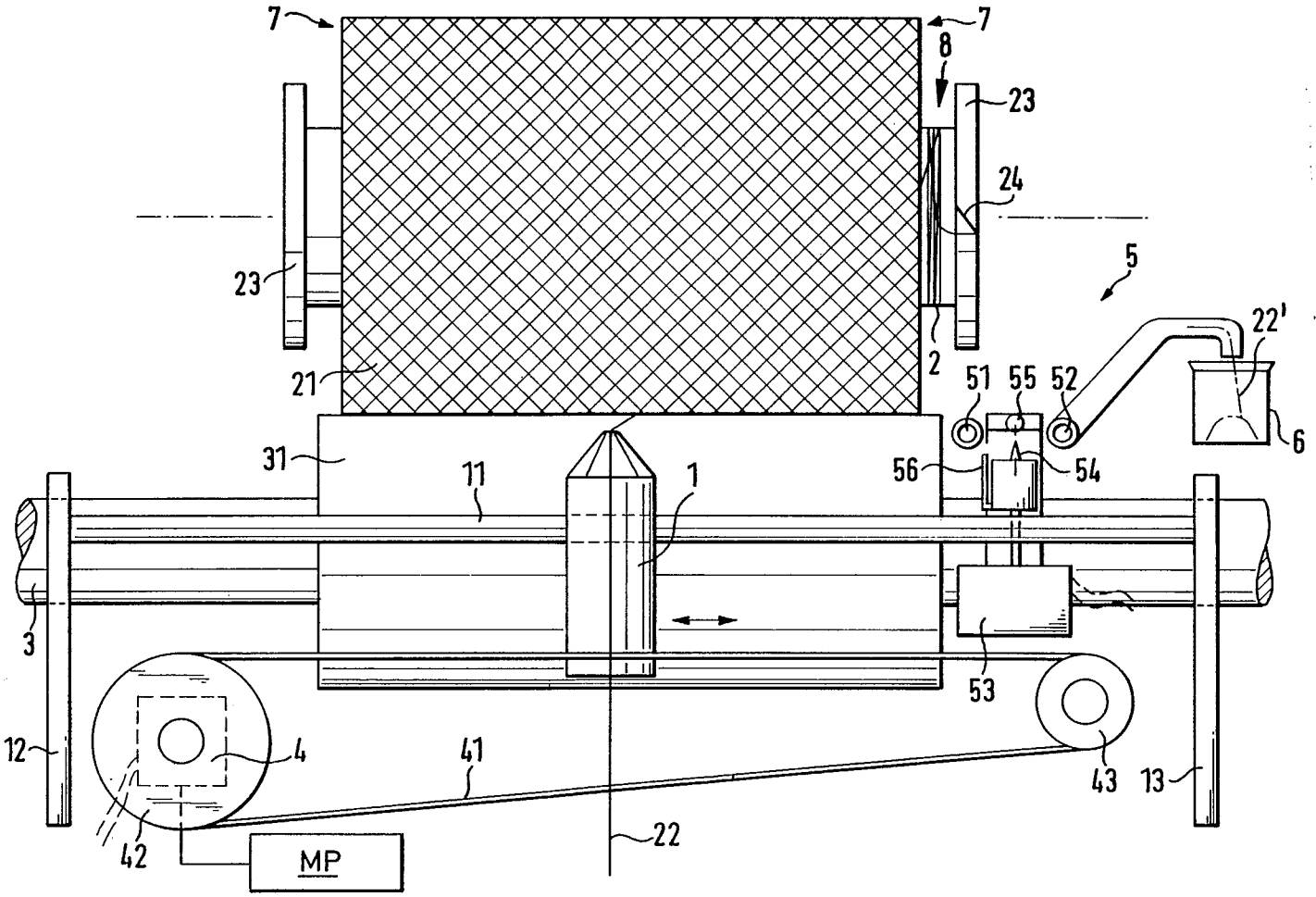
6
22'
5
52
54
55
51
56
23
24
7
8
2
13
43
53
1
22
11
41
21
31
4
MP
42
3
12

DEVICE AND PROCESS TO GUIDE, HOLD AND CONVEY A YARN DURING BOBBIN REPLACEMENT

BACKGROUND OF THE INVENTION

The instant invention relates to a process to guide, hold, and cut a yarn during bobbin replacement in a spinning and winding machine in which a continuously fed yarn is wound into a cross-wound bobbin and is conveyed into a lateral area next to the winding zone when a predetermined diameter of the cross-wound bobbin has been reached, until after completion of the replacement of the full cross-wound bobbin by an empty bobbin holder.

It is known that in order to convey the yarn continuously fed by from a spinning station to a winding station, additional mechanical and pneumatic yarn guides are used which remove the yarn from the yarn guide assigned to the winding process and convey it into a lateral area until bobbin replacement is completed (See German Patent Publication No. DE-OS 2,445,182).

These additional yarn guides are pivoted via actuation rods and rams from their rest position into their work position and hold the yarn away from the winding station. The yarn, which continues to be fed during that time, is taken up by a suction device. When the full cross-wound bobbin has been replaced by an empty bobbin former, the yarn is conveyed to a yarn clamping device, the yarn end is cut off with scissors and the rotation of the bobbin former is then started up.

The disadvantage with this device is the great number of mechanical means which must be driven in order to obtain the movements required for the conveying of the yarn. The great number of actuating rods and rams require extensive assembly and maintenance work resulting in production losses and high costs. This is especially true with spinning machines operating at high spinning speeds in which bobbin replacement and stoppage of the winding device must be kept as low as possible, since the yarn spun during bobbin replacement cannot be used for winding. Stopping the spinning process and subsequent re-piecing would be too expensive with open-end spinning machines.

The utilization of additional yarn guides which must seize the yarn for bobbin replacement results in a further disadvantage. Especially where high spinning and winding speeds, such as are obtained with open-end spinning machines are involved, the cross-winding speed is such that yarn transfer from the cross-winding guide to the additional yarn guide is not ensured. When the transfer of the yarn fails, valuable production time is lost and cross-wound bobbins which are too full or are not properly wound are produced.

A further disadvantage for the formation of the bobbin consists in the fact that the bobbin holder is accelerated by the release of a shoe brake after the yarn has been clamped. This results in poor yarn winding at constant yarn feeding speed because the yarn tension between bobbin former and winding station is uneven during the beginning of the winding process.

The process described in German Patent Publication No. DE-OS 3,411,158 uses an auxiliary yarn guide to convey the yarn during bobbin replacement, but this auxiliary yarn guide must be pivoted into a working position just as the additional yarn guide described earlier. The required movement sequence consists of several rotational and longitudinal movements and results in increased control, assembly and maintenance requirements. Following bobbin replacement, the yarn is placed into a yarn-catching notch on the empty holder where it is clamped. The yarn spun at the spinning station during bobbin placement is then torn off. This has the disadvantage that it is not possible to determine precisely at which point the yarn is torn, and it is thus possible that the yarn will break at the clamping point on the bobbin holder, or that it will be pulled back out of the clamping point. When this occurs, the yarn must be seized again and the clamping process must be repeated, leading to considerable time loss and lost productivity of the winding machine.

German Patent Publication No. DE-OS 2,230,947 shows a device in which a step motor takes over the cross-winding movement of a yarn guide. The cross-winding speed changes as a function of the rotational speed of the cross-wind bobbin. The signals for speed changes are detected by electromagnetic and electronic means. The yarn guide is driven via a shaft and moves back and forth in front of the winding zone. The disadvantage of this device is the great expenditure for signal detection as well as for the reversal of a first translational movement into a second translational movement which is contrary to the first one. This device is also suitable only for cross-winding, and not for assisting in the bobbin replacement, since a rotational movement of the cross-wound bobbin or of the element which drives the cross-wound bobbin is always a condition for the control of the step motor.

SUMMARY OF THE INVENTION

It is the object of the present invention to avoid the described disadvantages of the known devices and to create a process to guide, hold and cut a yarn and a device to carry out the bobbin replacement process even at high spinning speeds simply and without malfunctions. This object is attained through the invention. Advantageous further embodiments of the invention are described hereinafter.

BRIEF DESCRIPTION OF THE DRAWING

An embodiment of the invention is described with reference to the single FIGURE which shows a frontal view of the basic components of the winding station of an open-end spinning machine.

DETAILED DESCRIPTION OF THE DRAWING

A cross-winding guide 1 conveys a continuously fed yarn 22 through traversing movements, as indicated by the double arrow in the drawing, to a cross-wound bobbin 21. The cross-winding guide 1 is supported so as to be capable of displacement on a yarn guiding rod 11 mounted in a stationary manner in holding devices 12 and 13. The cross-wound bobbin 21 is on a bobbin holder 2 which is held on both sides by rotatably mounted bobbin plates 23. The bobbin plates 23 are attached in a known manner, which is not shown for that reason, making it possible to increase the distance between the bobbin holder 2 and a drive roller 31. The drive roller 31 is rotated by the axle 3 and drives the bobbin holder 2, the cross-wound bobbin 21 and the bobbin plates 23 via a friction connection. A catching device 24, to catch the yarn 22 at the beginning of the winding process, is attached to the outer circumference of the bobbin plate 23.

The movement of the cross-winding guide 1 is produced by a step motor 4 controlled by a microprocessor MP. Through gear 42, step motor 4 drives an endless toothed timing belt 41 which is deflected by a pulley 43. Cross-winding guide 1 is attached to the toothed belt 41. The microprocessor-controlled step motor 4 is characterized by very brief reversal times and excellent acceleration parameters. In addition, the microprocessor control makes it possible to determine reversal points and movement courses with great precision so that it is eminently suited for controlling the handling of the yarn 22 during the winding process and during the bobbin replacement. Once a predetermined diameter of the cross-wound bobbin 21 has been reached, step motor 4 moves the cross-winding guide 1 laterally next to the winding zone 7, in front of the yarn draw-off, cutting and lifting device 5.

Each yarn draw-off device comprises a pneumatic suction 51, 52. The yarn draw-off, cutting and lifting device 5 contains two suction devices 51 and 52 which are located laterally, next to a cutting knife 54 with a cylindrical roller 55 and a yarn lifter 56. The cutting knife 54 and the yarn lifter 56 are both attached to a lifting magnet 53. When the lifting magnet 53 is activated, the cutting knife 54 and the yarn lifter 56 move in direction of the bobbin plate 23. When the bobbin holder 2 is empty or almost empty, the lifting motion of the lifting magnet 53 is sufficient so that the periphery of the bobbin plate 23 is disposed adjacent to the cutting knife 54 and the yarn lifter 56. The yarn 22 between guide 1 and lifter 56 thus comes into contact with the catching device 24 mounted on the circumference of the bobbin plate 23. In the end position of the lifting magnet 53, the cutting knife 54 presses against the cylindrical roller 55. In this position, any yarn present between the cutting knife 54 and the cylindrical roller 55 is cut through.

Instead of the lifting magnet 53, it is also possible to use a pneumatic cylinder, for example. The suction device 52 is followed by a container 6, suitable to receive severed yarn remnants which are delivered by suction device 52. The described device functions according to the following method.

In the full winding operation, the cross-winding guide 1 traverses back and forth in front of the cross-wound bobbin 21. The cross-winding guide 1 is held in its relative position to the cross-wound bobbin 21 by the yarn guiding rod 11 which is, in turn, held in a stationary manner in the holding devices 12 and 13. The cross-winding guide 1 is driven by a microprocessor-controlled step motor 4 to which the cross-winding guide 1 is connected via a toothed belt 41. The step motor 4 can be driven by the microprocessor controls so that the cross-winding guide 1 places the yarn 22 on the cross-wound bobbin 21 in response to changes in the bobbin diameter. The rpm's of the cross-wound bobbin 21 decrease as the diameter increases while the rpm's of the axle 3 and of drive roller 31 remain constant. The yarn draw-off speed, however, remains basically constant, the cross-winding speed is adapted to this variable parameter, and a mostly uniform crossing angle is obtained on the cross-wound bobbin 21. The extremely low reversal times and the acceleration values of the step motor, 4 make it possible to dispense, in general, with special measures to avoid edge build-up on the cross-wound bobbin 21. If the results, nevertheless, should prove unsatisfactory, edge build-up can be avoided by the microprocessor controls.

When the cross-wound bobbin 21 has reached a predetermined diameter, the stepping motor 4 receives a signal and terminates the cross-winding process. The cross-winding guide 1 is then moved laterally from the winding zone 7 to in front of the yarn draw-off, cutting and lifting device 5, together with the yarn 22. When the cross-winding guide 1 is in front of the suction device 51, the yarn 22, which continues to be fed, is sucked up by suction device 51. When the yarn 22 has been seized by the suction device 51, the cross-winding guide 1 moves on to a second suction device 52. Here too, the yarn 22 is sucked up and the yarn 22, which continues to be fed, is sucked in so that a yarn loop forms inside suction device 52. Yarn 22 is now tensioned between the suction devices 51 and 52 so that it can easily be cut by means of a cutting knife 54. Cutting knife 54 is pressed against a cylindrical roller 55, preferably located between the suction devices 51 and 52, by means of the lifting magnet 53. The lifting magnet 53 receives the signal for the lifting movement when the cross-winding guide 1 has reached its position in front of the suction device 52, and when the yarn 22 has been seized by the suction device 52. When the yarn 22 is between the cutting knife and the cylindrical roller 55, it is cut during the lifting process. Lifting magnet 53 is then moved back into its starting position. The yarn end closest to the bobbin is now pulled out of the suction device 51 by cross-wound bobbin 21 which continues to rotate, and is wound up on cross-wound bobbin 21. The other yarn end is sucked off by suction device 52 in the same manner, as yarn 22 continues to be fed from the spinning station and is guided by the cross-winding guide 1.

When the yarn end closest to the bobbin has been wound up on the cross-wound bobbin 21, bobbin replacement takes place. The full cross-wound bobbin 21 is replaced by an empty bobbin holder 2, and the rotation of bobbin holder 2 is started up through pressure against the drive roller 31.

The cross-winding guide 1, together with yarn 22, is now brought in front of the yarn reserve area 8, so that it tensions the yarn 22 between cross-winding guide 1 and suction device 52. As soon as the cross-winding guide 1 reaches the yarn reserve area 8 the lifting magnet 53 is activated and lifts yarn 22, by means of the yarn lifter 56 attached to the lifting magnet 53 in the direction of bobbin plate 23. Bobbin plate 23, which rotates together with the bobbin holder 2, and which is equipped with a catching device 24, extends into range of the lifted yarn. The catching device 24 seizes yarn 22 and clamps it between bobbin holder 2 and bobbin plate 23. Immediately following this clamping, the yarn 22 is pressed by cutting knife 54, which is also actuated by the lifting magnet 53, against the cylindrical roller 55 and is cut.

The yarn 22', which has been cut off and sucked into suction device 52, is conveyed into the container 6 which follows suction device 52.

Cross-winding guide 1, located in front of the yarn reserve area 8, is slowly moved in the direction of the winding zone 7 by means of the microprocessor-controlled step motor 4 and, at the same time, provides a yarn reserve which cannot slide through, in that the yarn 22 is would several times around the rotating bobbin holder 2.

When the yarn reserve has been completed, cross-winding by the cross-winding guide 1 in front of the winding zone 7 is resumed. To this end, the cross-winding guide 1 moves back and forth in front of winding zone 7 and fills the cross-wound bobbin 21 in the manner described initially.

What is claimed is:

1. A process for replacing a full bobbin on a spinning and winding machine which has a traversing yarn guide for guiding a continuously fed yarn onto a bobbin holder in a cross-wound pattern, comprising the following steps:

(a) traversing said yarn guide in a winding zone until said bobbin reaches a predetermined diameter;
(b) moving said yarn and said yarn guide into a lateral area adjacent to said winding zone when said bobbin reaches said predetermined diameter;
(c) retaining said yarn and said yarn guide in said lateral area;
(d) severing said yarn adjacent said winding zone;
(e) removing said full bobbin and replacing it with an empty bobbin holder;
(f) moving said yarn and said yarn guide into said winding zone;
(g) winding said yarn onto said bobbin holder; and
(h) controlling the movements of said yarn guide by a microprocessor-controlled stepping motor.

2. A process as set forth in claim 1, including the step of retaining said yarn in said lateral area by spaced yarn draw-off devices.

3. A process as set forth in claim 2, including the step of severing said yarn between said yarn draw-off devices.

4. A process as set forth in claim 3, including the step of taking the yarn end closest to said bobbin from one of said yarn draw-off devices and winding it onto said cross-wound bobbin after said yarn is severed.

5. A process as set forth in claim 4, including the step of taking the other end of said severed yarn and drawing it off by the other of said draw-off devices during the bobbin replacement operation.

6. A process as set forth in claim 5, including the step of guiding said other end of said yarn to wind a yarn reserve onto said empty bobbin holder after said empty bobbin holder replaces said full bobbin.

7. A process as set forth in claim 6, including the step of moving said yarn by a yarn lifting device between the yarn reserve area and said other yarn draw-off device, into range of a catching device rotating with said empty bobbin holder.

8. A process as set forth in claim 7, including the step of cutting said yarn between said catching device and said other yarn draw-off device immediately after said yarn is caught by said catching device.

9. A process as set forth in claim 8, including the step of conveying said yarn in the direction of said winding zone so that the yarn reserve may be wound on one end of said bobbin holder and so that said cross-winding of said new bobbin is resumed in said winding zone when said yarn reserve has been completed.

10. A process as set forth in claim 8, including the step of drawing off said severed yarn end with said other yarn draw-off device.

11. In a yarn spinning and winding machine, wherein yarn is continuously spun and cross-wound onto a bobbin holder to form a cross-wound bobbin, comprising:

(a) a traversing yarn guide for guiding said yarn onto said bobbin holder;
(b) an endless band connected to said traversing yarn guide for traversing said yarn guide;

a stepping motor for driving said endless band; and microprocessor control means including means to control said stepping motor to traverse said traversing yarn guide within a yarn winding zone until said bobbin is filled to a predetermined diameter, and to move said traversing yarn guide laterally into a yarn draw-off zone after said bobbin reaches said predetermined diameter.

12. In spinning and winding machine as set forth in claim 11, wherein said endless band for traversing said yarn guide is a toothed belt.

13. In a yarn spinning and winding machine as set forth in claim 11, further comprising cutting and lifting means which are disposed for intersecting and cutting said yarn in said draw-off zone.

14. In a yarn spinning and winding machine as set forth in claim 13, further comprising a pneumatic yarn draw-off device disposed within said draw-off zone in a position for intersecting, holding, and drawing off said yarn.

15. In a yarn spinning and winding machine as set forth in claim 13, wherein said yarn cutting means comprises a lifting magnet, a cutting knife, and a cylindrical roller cooperating with said cutting knife.

16. In a yarn spinning and winding machine as set forth in claim 15, wherein said yarn cutting means and said yarn lifting means are disposed in one assembly which is deployed by said lifting magnet.

17. In a yarn spinning and winding machine as set forth in claim 16, wherein said yarn cutting and lifting means is controlled to move said yarn into the range of a catching device adjacent said bobbin holder.

18. In a yarn spinning and winding machine as set forth in claim 15, wherein said yarn cutting and lifting means is disposed in a stationary position in said draw-off zone.

19. In a yarn spinning and winding machine as set forth in claim 11, which includes draw-off means which comprises spaced suction members for drawing the yarn fed into said draw-off zone after it is cut by the cutting means and deposits said yarn into a container.

* * * * *